US010023812B2

(12) United States Patent
Garcia, III et al.

(10) Patent No.: US 10,023,812 B2
(45) **Date of Patent: *Jul. 17, 2018**

(54) METHOD FOR REMOVING METALS AND AMINES FROM CRUDE OIL

(71) Applicant: ECOLAB USA Inc., St. Paul, MN (US)

(72) Inventors: Juan M. Garcia, III, Sugar Land, TX (US); Samuel A. Lordo, Fulshear, TX (US); Michael L. Braden, Sugar Land, TX (US)

(73) Assignee: ECOLAB USA INC., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/702,314

(22) Filed: Sep. 12, 2017

(65) Prior Publication Data

US 2018/0002613 A1 Jan. 4, 2018

Related U.S. Application Data

(63) Continuation of application No. 12/563,583, filed on Sep. 21, 2009, now Pat. No. 9,790,438.

(51) Int. Cl.

| | |
|---|---|
| ***C10G 17/04*** | (2006.01) |
| ***C10G 17/09*** | (2006.01) |
| ***C10G 33/02*** | (2006.01) |
| ***C10G 33/04*** | (2006.01) |
| ***C10G 17/02*** | (2006.01) |

(52) U.S. Cl.
CPC ..... *C10G 17/04* (2013.01); *C10G 17/02* (2013.01); *C10G 17/09* (2013.01); *C10G 33/02* (2013.01); *C10G 33/04* (2013.01); *C10G 2300/202* (2013.01); *C10G 2300/205* (2013.01); *C10G 2300/80* (2013.01); *C10G 2300/805* (2013.01)

(58) Field of Classification Search
CPC ..... C10G 17/02; C10G 17/04; C10G 17/09; C10G 31/08; C10G 33/02; C10G 33/04
See application file for complete search history.

(56) References Cited

U.S. PATENT DOCUMENTS

| | | | | |
|---|---|---|---|---|
| 4,789,463 | A | 12/1988 | Reynolds | |
| 5,080,779 | A * | 1/1992 | Awbrey | C10G 17/02 208/251 R |
| 7,497,943 | B2 * | 3/2009 | Nguyen | B01D 17/0217 208/179 |
| 2004/0045875 | A1 | 3/2004 | Nguyen et al. | |

* cited by examiner

*Primary Examiner* — Renee Robinson
(74) *Attorney, Agent, or Firm* — Eric D. Babych; Brinks Gilson & Lione

(57) ABSTRACT

A method of removing metals and amines from crude oil comprising adding an effective metal removing amount of one or more hydroxycarboxylic acids selected from lactic acid and malic acid and salts thereof to said crude oil; adding wash water to said crude oil; mixing said crude oil, acid and wash water to form an emulsion; and resolving said emulsion into an aqueous phase and crude oil having a reduced metals content.

13 Claims, No Drawings

METHOD FOR REMOVING METALS AND AMINES FROM CRUDE OIL

TECHNICAL FIELD

This invention relates to a process for the removal of metals, particularly calcium, from petroleum crudes having unacceptably high levels of such metals in refinery desalting processes where certain hydroxycarboxylic acids are added to the crude oil rather than to wash water.

BACKGROUND OF THE INVENTION

A few, but increasingly important, petroleum crude feedstocks contain levels of metals such as iron and calcium which render them difficult, if not impossible, to process using conventional refining techniques. For example, calcium contaminants causing particular problems can take the form of non-porphyrin, organometallically-bound compounds. One class of these calcium-containing compounds include calcium naphthenates and their homologous series. These organo-calcium compounds are not separated from the feedstock by normal desalting processes, and in a conventional refining technique they can cause coker furnace fouling, drive residual fuel off specification for metals and result in the very rapid deactivation of hydroprocessing catalysts. One example of feedstocks demonstrating objectionably high levels of calcium compounds are West African Doba crudes.

The use of hydroxycarboxylic acids to aid in the removal of metals including calcium and iron from crude oil in refinery desalting processes is disclosed in U.S. Pat. Nos. 4,778,589 and 4,789,463, respectively.

A method of removing metals from crude oil in refinery desalting processes, in which a variety of acids, including $C_2$-$C_4$ hydroxycarboxylic acid are added to wash water prior to contacting the wash water with crude oil is disclosed in U.S. Pat. No. 7,497,943.

A method of removing iron from crude oil in refinery desalting processes where various chelants are added to the crude oil prior to addition of wash water is disclosed in U.S. Pat. No. 5,080,779.

SUMMARY OF THE INVENTION

We have unexpectedly discovered that addition of hydroxycarboxylic acids including lactic acid and malic acid and wash water separately to crude oil in conventional crude oil desalting operations results in enhanced removal of amines and bound and unbound metal contaminants, particularly calcium, from the crude oil.

Accordingly, in an embodiment, this invention is a method of removing metals and amines from crude oil comprising adding an effective metal removing amount of one or more hydroxycarboxylic acids selected from lactic acid and malic acid and salts thereof to said crude oil; adding wash water to said crude oil; mixing said crude oil, acid and wash water to form an emulsion; and resolving said emulsion into an aqueous phase and crude oil having a reduced metals content.

DETAILED DESCRIPTION OF THE INVENTION

In refinery crude oil desalting operations, a water-in-oil (w/o) emulsion is intentionally formed by adding water, commonly referred to as "wash water" to the crude oil with the wash water being admitted on the order of about 3-10 volume percent based on the crude oil. The wash water is added to the crude and mixed intimately to transfer impurities such as chlorides in the crude to the water phase. The w/o emulsion is then pumped into the desalter unit where separation of the phases occurs due to coalescence of the small water droplets into progressively larger droplets and eventual gravity separation of the oil and underlying water phase.

Desalters are ordinarily provided with electrodes to impart an electrical field in the desalter. This serves to polarize the dispersed water molecules. The so-formed dipole molecules exert an attractive force between oppositely charged poles with the increased attractive force increasing the speed of water droplet coalescence by from ten to one hundred fold. The water droplets also move quickly in the electrical field, thus promoting random collisions that further enhance coalescence.

Also, the desalters are generally provided with heat imparting means and pressure control means to respectively control temperature and pressure within the vessels. Typically, desalter temperatures are maintained at about 200-300° F. Heat lowers the viscosity of the continuous phase (i.e., oil) therefore speeding the settlement of the coalesced water droplets. It also increases the ability of bulk oil to dissolve certain organic emulsion stabilizers that may have been added or are naturally occurring in the crude.

Desalter pressure is kept high enough to prevent crude oil or water vaporization. Vaporization causes water carry over into the crude oil leaving the desalter. Desalter pressure at operating temperatures should generally be about 20 psi above the crude oil or water vapor pressure, whichever is lower.

Upon separation of the phases from the w/o emulsion, the crude is commonly drawn off the top of the desalter and sent to the fractionator tower in crude units or other refinery processes. The water phase containing water-soluble metal salt compounds and sediment is discharged as effluent.

This invention is an improved refinery desalting operation comprising (i) providing crude oil; (ii) adding wash water to the crude oil and mixing to form and emulsion; and (iii) resolving the emulsion to provide an aqueous phase and crude oil having a reduced metal and amine content in which the improvement comprises adding an effective metal removing amount of one or more hydroxycarboxylic acids selected from italic acid and lactic acid and salts thereof to the crude oil separately from the wash water. Salts of the hydroxycarboxylic acids include, for example, alkali metal salts such as sodium and potassium salts and ammonium salts. "Separately from the wash water" means a separate addition point which may be upstream or downstream of the wash water addition.

"Crude oil" means any hydrocarbon feedstock used in refinery operations including crude petroleum, atmospheric or vacuum residua, solvent deasphalted oils derived from these crudes and residua shale oil, liquefied coal, beneficiated tar sand, and the like and blends thereof. The crude oil may also be treated with one or more processing aids including solvents, demulsifiers, corrosion inhibitors, and the like. In embodiment, the crude oil is petroleum crude. In an embodiment, the petroleum crude is Doba crude or a crude oil slate comprising Doba crude.

Metals suitable for removal using the process of this invention include, but are not limited to calcium, iron, zinc, silicon, nickel, sodium, potassium, vanadium, and the like and mixtures thereof. In an embodiment, the metals include iron and calcium. In an embodiment, the metal is calcium in its bound and unbound forms.

Amines suitable for removal using the process of this invention include, but are not limited to, monoethanolamine, diethanolamine, triethanolamine, N-methylethanolamine, N,N-dimethylethanolamine, morpholine, N-methyl morpholine, ethylenediamine, methoxypropylamine, N-ethyl morpholine, N-methyl ethanolamine, N-methyl diethanolamine, and the like and mixtures thereof.

The malic and/or lactic acid may be added as an aqueous solution. In an embodiment, the aqueous solution comprises about 40 to about 70 weight percent of the acids.

The effective amount of malic and/or lactic acid is the amount of acid required to achieve the desired amount of metal or amine removal from the crude oil and can be determined by one of skill in the art taking into account the characteristics of the acids, the crude oil being treated and any additional process parameters.

In an embodiment, the amount of acid added to the crude oil is an amount sufficient to result in a pH of about 3 to about 6 in the separated aqueous solution.

In general, about 1 to about 2,000 ppm of the hydroxycarboxylic acids are added to the crude oil. In an embodiment, about 10 to about 500 ppm of the hydroxycarboxylic acids are added to the crude oil.

In an embodiment, the hydroxycarboxylic acid is malic acid.

The hydroxycarboxylic acids may be, used in combination with one or more adjuvants employed in refinery desalting processes including corrosion inhibitors, demulsifiers, pH adjusters, metal complexing agents, scale inhibitors, hydrocarbon solvents, and the like. The adjuvants may be independently added to the crude oil, to the wash water, or formulated with the acid solution. For example, oil soluble adjuvants such as demulsifiers and corrosion inhibitors may be added directly to the crude oil while water soluble adjuvants may be formulated with the acids or added to the wash water.

In an embodiment, one or more demulsifiers are added to the crude oil of the wash water.

In an embodiment, one or more corrosion inhibitors are added to the crude oil or the wash water.

In an embodiment, one or more corrosion inhibitors are added to the wash water.

In an embodiment, the hydroxycarboxylic acids are added to the crude oil upstream of the corrosion inhibitor-containing wash water.

In an embodiment, the hydroxycarboxylic acids are added to the crude oil downstream of the corrosion inhibitor-containing wash water.

In an embodiment, one or more metal complexing agents, not including malic acid and lactic acid, to the crude oil or the wash water.

Metal complexing agents include a broad class of chemicals that coordinate or complex metal ions. Representative metal complexing agents include, but are not limited to ethylenediaminetetra acetic acid (EDTA), glycolic acid, gluconic acid, thioglycolic acid, tartaric acid, mandelic acid, citric acid, acetic acid, oxalic acid, nitrolotriacetic acid (NTA), ethylenediamine (EDA), methanesulfonic acid, malonic acid, succinic acid, maleic acid, dithiocarbamates and polymeric dithiocarbamates, and the like and salts thereof.

In a representative refinery application, crude oil containing about 70 ppm calcium is processed in a conventional desalting operation which comprises a preheat train which includes preheat exchangers, a mix valve downstream of the preheat train and an electrostatic desalter. Upwards of 150,000 bbl/day of crude oil containing about 20% (30,000 bbls) of Doba crude oil are processed. Wash water treated with a corrosion inhibitor is added to the crude oil stream at a rate of about 5% (7,500 bbl/day). A 50% aqueous solution of hydroxycarboxylic acid is added to the crude charge at a dosage rate of about 2,000 to about 3500 gal/day upstream of wash water. The crude oil emulsion formed by the mix valve is resolved by electrostatic coalescence in the desalter to effect removal of up to about 95% of the calcium from the crude oil.

The foregoing may be better understood by reference to the following Example, which is presented for purposes of illustration and are not intended to limit the scope of this invention.

EXAMPLE 1

A 50 weight percent solution of crude oil in toluene is heated for about 20 minutes at 180° F. and the heated crude oil sample is then mixed with a 10 weight percent aqueous solution of hydroxycarboxylic acid. The mixture is heated and shaken for about 30 minutes. At the end of the extraction cycle, the samples are immediately heated for a second, 10-minute heating cycle, after which, the phases are allowed to separate in a reparatory funnel. The calcium and iron content of the recovered phases is determined by ICP analysis. The results are summarized in Table 1.

TABLE 1

| Treating agent | Blank | Hydroxycarboxylic acid, 1.54 molar equiv. | Hydroxycarboxylic acid, 2.47 molar equiv. |
|---|---|---|---|
| Calcium Removed | 8.3 ppm | 94.3% | 93% |
| Iron Removed | 35 ppm | 70% | 70% |

While the present invention is described above in connection with representative or illustrative embodiments, these embodiments are not intended to be exhaustive or limiting of the invention. Rather, the invention is intended to cover all alternatives, modifications and equivalents included within its spirit and scope, as defined by the appended claims.

The invention claimed is:

1. A method of removing metals and amines from crude oil comprising adding an approximately 40% to approximately 70% aqueous solution of malic acid or a salt thereof to said crude oil; separately adding wash water to said crude oil and mixing said crude oil, acid and wash water to form an emulsion; and resolving said emulsion into an aqueous phase and crude oil having a reduced metals and amines content, wherein the malic acid or salt thereof is added to the crude oil upstream of the wash water.

2. The method of claim 1, wherein the malic acid or salt thereof is added to the crude oil before it arrives at any desalter units.

3. The method of claim 1, wherein the metal is calcium.

4. The method of claim 1, wherein a pH of the separated aqueous phase is about 3-6.

5. The method of claim 1, further comprising adding one or more demulsifiers to the crude oil or the wash water.

6. The method of claim 1, further comprising adding one or more corrosion inhibitors to the crude oil or the wash water.

7. The method of claim 1, further comprising adding one or more metal complexing agents, not including malic acid and lactic acid, to the crude oil or the wash water.

8. The method of claim 7, wherein one or more corrosion inhibitors are added to the wash water.

9. The method of claim 1, wherein said emulsion is resolved using electrostatic coalescence.

10. The method of claim 1, wherein the crude oil is petroleum crude.

11. The method of claim 10, wherein the petroleum crude comprises Doba crude.

12. A refinery desalting process for removing metals and amines from crude oil comprising:

(i) providing crude oil;

(ii) adding wash water to the crude oil;

(iii) mixing said crude oil and said wash water to form an emulsion; and (iv) resolving the emulsion to provide an aqueous phase and crude oil having a reduced metal and amine content, the process further comprising adding an approximately 40% to approximately 70% aqueous solution of malic acid or a salt thereof to the crude oil separate from addition of the wash water, wherein the malic acid or salt thereof is added to the crude oil upstream of the wash water.

13. The method of claim 12, wherein an amount of the malic acid or the salt thereof added to the crude oil is from 500 ppm to 2,000 ppm.

* * * * *